US010431906B1

(12) United States Patent
Reed et al.

(10) Patent No.: US 10,431,906 B1
(45) Date of Patent: Oct. 1, 2019

(54) AUTOMOTIVE WIRING HARNESS FLAT CABLE END TERMINATION

(71) Applicant: FORD GLOBAL TECHNOLOGIES, LLC, Dearborn, MI (US)

(72) Inventors: Glenn Richard Reed, Ann Arbor, MI (US); Paul J. Nicastri, Dearborn, MI (US)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 0 days.

(21) Appl. No.: 16/033,592

(22) Filed: Jul. 12, 2018

(51) Int. Cl.

| | |
|---|---|
| ***H01R 4/20*** | (2006.01) |
| ***H01B 7/08*** | (2006.01) |
| ***H01R 4/62*** | (2006.01) |
| ***H01B 7/00*** | (2006.01) |
| ***H01R 9/22*** | (2006.01) |
| ***H01B 7/04*** | (2006.01) |

(52) U.S. Cl.
CPC ..... *H01R 4/20* (2013.01); *H01B 7/0045* (2013.01); *H01B 7/04* (2013.01); *H01B 7/0823* (2013.01); *H01R 4/62* (2013.01); *H01R 9/223* (2013.01)

(58) Field of Classification Search
CPC ..... H01R 4/20; H01R 13/03; H01B 7/0045; H01B 7/04; H01B 7/0823
USPC ..... 439/720, 77, 879, 422, 741, 753
See application file for complete search history.

(56) References Cited

U.S. PATENT DOCUMENTS 2,740,095 A * 3/1956 Somes ..... H01B 11/18 138/115
2,973,502 A * 2/1961 Tally ..... H01B 7/0018 174/117 FF
3,084,302 A * 4/1963 Braeutigam ..... H01R 12/774 439/327
3,474,399 A * 10/1969 Teagno ..... H01R 4/203 174/84 C
3,890,701 A * 6/1975 Diepers ..... B23K 20/001 174/125.1
4,052,784 A * 10/1977 Diepers ..... H01L 39/2406 29/599
4,302,065 A * 11/1981 Taylor ..... H01R 12/62 174/88 R (Continued)

FOREIGN PATENT DOCUMENTS

CN 206673297 U 11/2017
DE 102006046350 A1 4/2008

(Continued)

*Primary Examiner* — Tulsidas C Patel
*Assistant Examiner* — Peter G Leigh
(74) *Attorney, Agent, or Firm* — Frank L. Lollo; MacMillan, Sobanski & Todd, LLC

(57) ABSTRACT

An electrical distribution apparatus is adapted for use in a wiring harness of an automotive electrical system. A flat flexible cable has an insulating substrate embedding a plurality of flat wires. The flat cable has a cable end wherein the wires extend as exposed blade fingers, each finger having at least one lateral fold stacking a thickness of the respective finger. A ferrule is crimped over each stacked finger. A plurality of contact bodies each has a coupler end and a crimp end. Each crimped end has a pair of legs crimped onto a respective ferrule. A carrier block has a plurality of bores each receiving a respective coupler end. The carrier block carrying the coupler ends is configured to plug into an electronic module connector in the automotive electrical system.

15 Claims, 6 Drawing Sheets

(56) References Cited

U.S. PATENT DOCUMENTS 4,952,256 A 8/1990 Schauer et al.
5,375,321 A * 12/1994 Rohatgi ..... H05K 1/0218 29/830
5,651,694 A * 7/1997 Miyasaka ..... H02B 1/202 439/492
5,749,756 A * 5/1998 Vockroth ..... H01R 4/203 174/84 C
5,860,831 A 1/1999 Röder et al.
6,126,459 A 10/2000 Reddy et al.
6,334,798 B1 * 1/2002 Ushijima ..... H01R 4/187 439/203
6,375,492 B1 * 4/2002 Hio ..... H01R 12/68 439/422
6,824,426 B1 * 11/2004 Spink, Jr. ..... H01R 24/62 439/579
7,048,551 B2 * 5/2006 Takayama ..... H01R 4/185 439/67
7,207,850 B2 * 4/2007 Takayama ..... H01R 4/185 439/850
7,338,334 B2 * 3/2008 Kumakura ..... H01R 43/16 29/857
8,834,213 B2 * 9/2014 Sato ..... H01R 4/185 439/866
8,876,564 B2 * 11/2014 Sato ..... H01R 4/184 439/879
8,975,510 B2 3/2015 Coakley
9,033,751 B2 * 5/2015 Sato ..... H01R 4/206 439/877
9,172,151 B2 * 10/2015 Sato ..... H01R 4/206
9,368,953 B2 * 6/2016 Mori ..... H01R 11/12
9,397,437 B2 * 7/2016 Ohnuma ..... H01R 4/185
9,466,777 B2 10/2016 Coakley et al.
9,640,877 B2 * 5/2017 Aoki ..... H01R 4/185
9,832,857 B2 11/2017 Coakley et al.
9,844,148 B2 12/2017 Coakley et al.
9,853,280 B2 * 12/2017 Zhao ..... H01M 2/1077
9,973,051 B2 * 5/2018 Ogawa ..... H01R 4/184
2005/0227549 A1 * 10/2005 Takayama ..... H01R 4/185 439/851
2009/0269970 A1 * 10/2009 Kumakura ..... H01R 4/185 439/421
2014/0224536 A1 * 8/2014 Ito ..... H01R 4/184 174/84 C
2014/0262501 A1 * 9/2014 Stol ..... H01R 4/02 174/94 R
2014/0318849 A1 * 10/2014 Ito ..... H01R 4/182 174/267
2017/0094802 A1 3/2017 Coakley et al.
2017/0331202 A1 * 11/2017 Aoki ..... H01R 4/185
2018/0026385 A1 * 1/2018 Kato ..... H01R 13/03 439/886

FOREIGN PATENT DOCUMENTS

DE 102011081997 B3 11/2012
EP 0991151 A2 5/2000

* cited by examiner

AUTOMOTIVE WIRING HARNESS FLAT CABLE END TERMINATION

CROSS REFERENCE TO RELATED APPLICATIONS

Not Applicable.

STATEMENT REGARDING FEDERALLY SPONSORED RESEARCH

Not Applicable.

BACKGROUND OF THE INVENTION

The present invention relates in general to electrical distribution systems for automotive vehicles, and, more specifically, to connector systems for adapting flat flexible cables to plug-in connectors.

An automotive vehicle utilizes many electronic modules and systems. For proper operation, the electronic modules are connected to one another through one or more wiring harnesses to distribute electrical power and various signals (e.g., commands and data). To facilitate assembly and repair of the electronic modules in the vehicle, connectors are used to couple the wiring harnesses to the electronic modules. Insulated cables (i.e., wires) are typically bound together forming various routing segments using straps, cable ties, adhesive tape, and/or conduits. Besides requiring labor-intensive processes of manufacturing, wiring harnesses may occupy a large volume within the automotive vehicle and may add significant weight. The bundling of wires may also restrict the ability to dissipate heat generated by power losses in wires carrying high current levels.

Flat, flexible cable technologies are being adapted for use in electrical distribution for automotive vehicles to reduce system volume and weight. Due to the increase in surface area of a flat wire relative to a round wires usually used in wiring harnesses, heat is more easily dissipated and higher current levels can be handled even while the total mass of the conductors and volume of the harness are reduced.

Flexible flat cable systems (such as ribbon cables) employ one or more insulating layers embedding a plurality of flat conductor wires. Typically, a flexible plastic film is used as a base for the insulating layer. Flat metallic conductor strips are laminated to one surface and are sometimes etched to obtain a desired circuit pattern. An insulating topcoat may then be laminated over the wiring pattern. End terminations for the wires typically employ an uncovered pad at an endpoint of a run of the flex cable. Various terminal connectors specifically configured to handle flex flat cable wiring are known for including in a module or other components in order to connect them to a ribbon-type cable.

Typical electronic modules and other components in automotive electrical systems have been designed with plug-in connector interfaces to the wiring harness. These interfaces do not accept the types of terminal connections that are provided with the flat cables. When switching over from round-wire harnesses to a harness using a flexible flat cable system, it has been necessary to redesign the modules which connect to the harness or to added specially designed adapters to convert between connection systems. The time, effort, and cost of redesigning the modules may impede the incorporation of flat wiring into the wiring harness and deter a vehicle manufacturer from obtaining the weight, volume, and other advantages of using flat wiring.

Even when the target modules or components to be connected to the flat wiring harness have compatible terminal connectors, the flat cable systems can have a disadvantage wherein the terminal ends become damaged during handling of a laminated cable section as it is transported to a location where the connector elements are assembled onto the harness. The wire ends may be comprised of very thin sheets (i.e., foil) of copper or aluminum that may be easily damaged, especially when the wire traces extend out from the insulating layers as an unsupported blade or finger.

SUMMARY OF THE INVENTION

In order to provide a flat flexible wiring harness system with end terminations that can be utilized with connector components widely used for round-wire harnesses, the invention modifies the end terminations by extending individual flat wires beyond the insulating substrate and by bending the flat wire back upon itself (e.g., as a zig-zag folded planar strip) a sufficient number of times until it provides a cross sectional area substantially equivalent to the round wire being replaced (e.g., within 20%). To obtain the round shape, a ferrule or collar having a cylindrical shape and made of conductive metal with a sufficiently large inside diameter is placed over the folded planar strip and then crimped in order to compress the folded strip. The final size of the crimped ferrule substantially matches the size of the round wire being replaced and is suitable for use in further processing for fabricating terminal connections used for round wire applications.

In one aspect of the invention, an electrical distribution apparatus comprises a flat flexible cable having an insulating substrate embedding a plurality of flat wires. The flat cable has a cable end wherein the wires extend as exposed blade fingers, each finger having at least one lateral fold stacking a thickness of the respective finger. A ferrule is crimped over each stacked finger. A plurality of contact bodies each has a coupler end and a crimp end. Each crimped end has a pair of legs crimped onto a respective ferrule. A carrier block has a plurality of bores each receiving a respective coupler end. The carrier block carrying the coupler ends is configured to plug into an electronic module connector in an automotive electrical system.

DETAILED DESCRIPTION OF PREFERRED EMBODIMENTS

Figure 1:
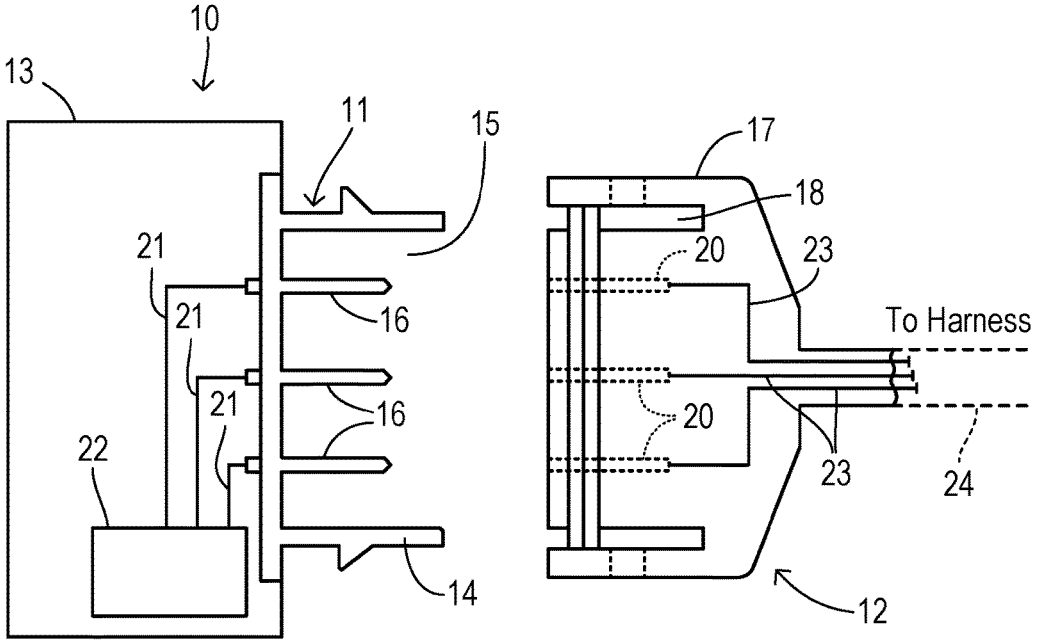
Fig. 1 (Prior Art)
FIG. 1 is a diagram depicting a plug-in connector system for joining an electronic module and a round-wire cable harness.

FIG. 1 shows a connector system for an electronic module 10 that includes a connector header 11 configured to receive a harness connector 12. Harness connector 12 and header 11 are in an unconnected state. Electronic module 10 has a housing 13 that is configured to contain and shelter associated electronic components. Connector header 11 has a header outer wall 14 extending from housing 13 to define a cavity 15 for a plurality of pins 16. Header outer wall 14 may also be configured to facilitate connection with harness connector 12 by insertion into a channel 18 in a connector body 17 of harness connector 12. Header wall 14 may include one or more sloped protrusions to be received in corresponding notches in body 17 to for secure harness connector 12 to connector header 11 as known in the art.

Pins 16 are conductive elements that extend into cavity 15 and are configured to be received by corresponding conductive recesses 20 within harness connector body 17. Pins 16 are coupled to conductive elements 21 to electrically connect pins 16 to a controller 22 or other electrical or electronic circuitry. In the connected position, pins 16 and recesses 20 form a conductive path from controller 22 to a wire bundle 23 that are part of a wiring harness 24.

Many different types of electronic modules are already in mass production using a connector header of the type shown in FIG. 1 which is incompatible with a typical terminal end of a flat flexible cable system. In order to utilize a flat flexible cable system, either the electronic module has to be re-designed to incorporate a different connector header or a specialized adapter for converting between flat and round wiring have been required. The invention provides a terminal system avoiding both.

Figure 2:
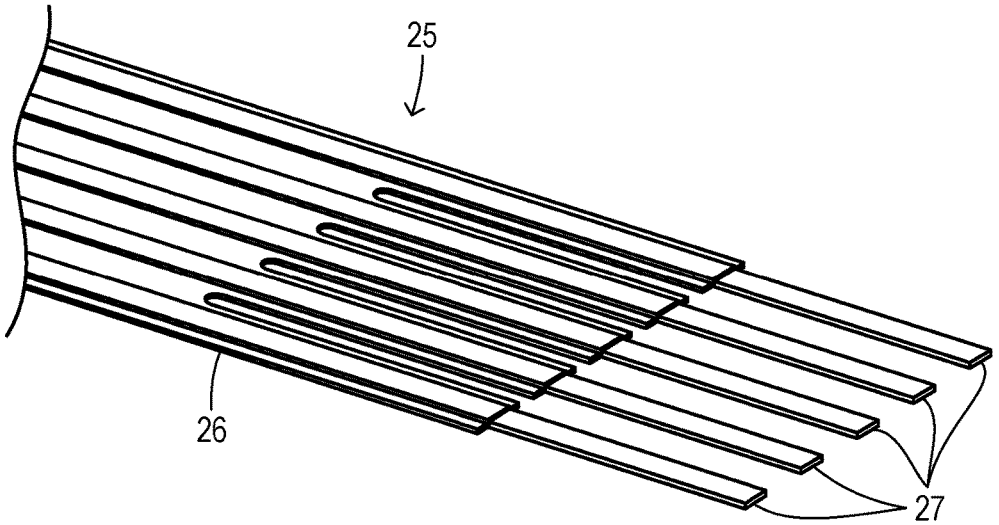
FIG. 2 is a perspective view of an end of a known type of flexible flat cable with conductor wires exposed for making a terminal connection.

As shown in FIG. 2, an electrical distribution system may have a wiring harness that includes a flat, flexible cable 25 wherein an insulating substrate 26 embeds a plurality of flat wires 27. Substrate 26 may typically include two or more distinct layers with wires 27 sandwiched between different insulating layers. The ends of wires 27 are shown extending from substrate 26 as exposed, uninsulated blade fingers which can be joined to specialized connectors for flat wires as known in the art. In other commonly used configurations, the flat wires do not extend beyond the edge of the substrate. Instead, a portion of the wires are exposed by window openings in the insulating layer(s) and are joined to conductive elements of a connector by clamping or soldering, for example.

The exposed blade fingers of wires 27 are shown as individual strips having a length greater than what is typically made for known terminal connections. The extra length provides a desirable amount of material for building up a conductive mass equivalent to a round wire by folding each wire 27 into a stack with a cross sectional area matching the cross sectional area of the round wire being replaced.

Figure 3:
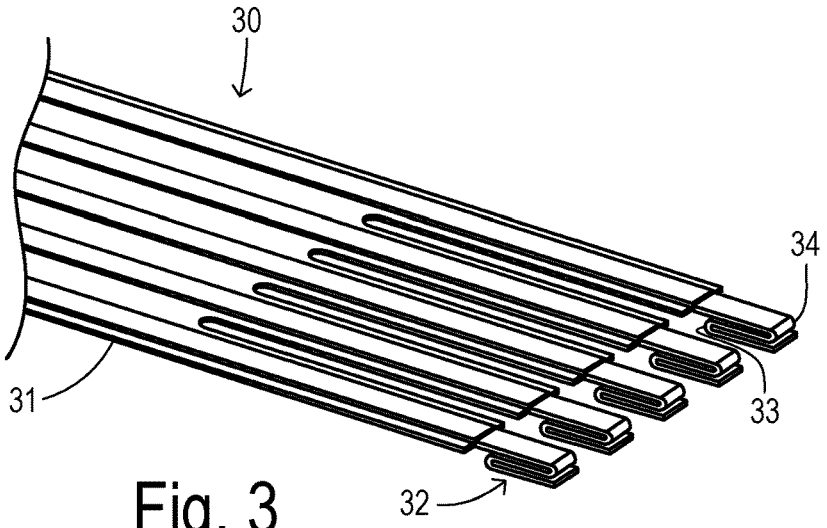
FIG. 3 is a perspective view of an end of a flexible flat cable with blade fingers in a folded state, according to one embodiment of the invention.

As shown in FIG. 3, a flat, flexible cable 30 has an insulating substrate 31 embedding a plurality of flat wires 32. The ends of wires 32 extend from substrate 31 as exposed, uninsulated blade fingers wherein each blade finger has at least one lateral fold stacking a thickness of the respective finger. As used herein, "lateral fold" means a fold having an edge which extends laterally across the respective blade finger strip such that each wire 32 folds back upon itself. Successive folds may continue in a "zig zag" manner to accumulate a stacking thickness which when multiplied by the lateral width of the blade fingers provides a predetermined cross sectional area. In FIG. 3, there are two lateral folds which triples the cross sectional area of the flat wire.

Figure 4:
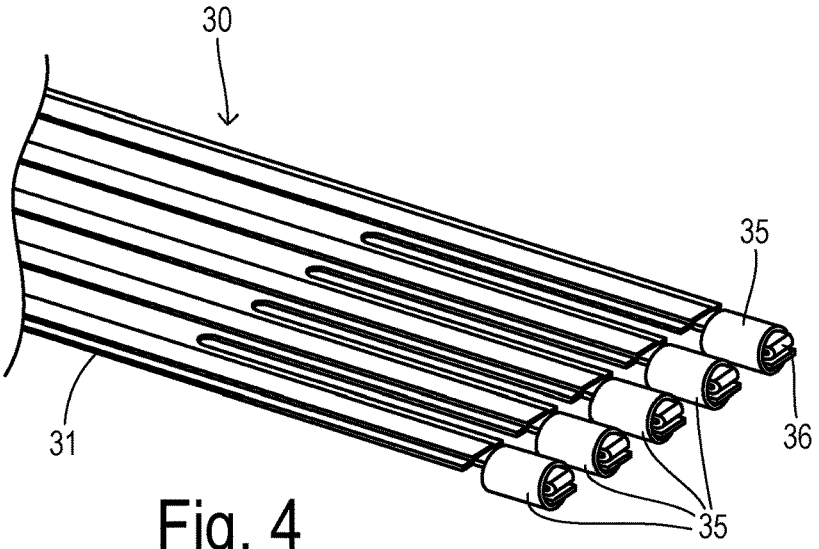
FIG. 4 is a perspective view of the end of a flexible flat cable of FIG. 3 with a ferrule added to each of the blade fingers.
Figure 5:
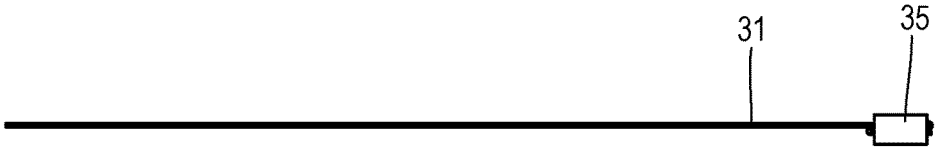
FIG. 5 is a side view of the flat cable of FIG. 4.

In order to convert the rectangular cross-sectional shape of the stacked finger to a round cross section, a ferrule or collar 35 is crimped over each stack as shown in FIGS. 4 and 5. Ferrule 35 has a cylindrical shape with an initial inner diameter large enough to slide over a stacked end 36 of the flat wire. Ferrule 35 is comprised of conductive metal which deforms during crimping in which a tool or press with a cylindrical channel compresses ferrule 35 onto stacked end 36. The folding of the blade fingers and the crimping placement of the ferrules onto the stacked ends may preferably occur at a manufacturing facility that forms the flat flexible cables. In addition to providing a round or oval shape, ferrules 35 protect the stacked terminal ends 36 of the flat wires from damage (e.g., bending or tearing) that could occur during shipping or handling of the cable systems from the original manufacturing facility to a final wiring harness assembly location.

Figure 6A:
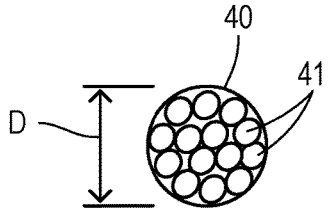
FIG. 6A is a cross-sectional view of a conventional stranded wire of a type used in wiring harnesses which is crimped into a connector contact.

FIG. 6A shows a cross section of a round wire 40 of a type being replaced by a flat wire. Wire 40 may include a plurality of strands 41 or can be a solid body, and may be comprised of copper, aluminum, or other materials as known in the art. Wire 40 has a diameter D, so that its cross sectional area is equal to $$\pi \cdot \left(\frac{D}{2}\right)^2.$$

Figure 6B:
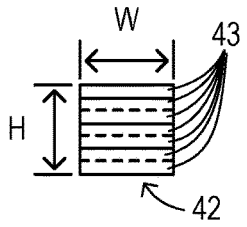
FIG. 6B is a cross-sectional view of a stack formed by a folded blade finger.

FIG. 6B shows a cross section of a stacked (folded) end 42 of a flat wire having a width W. A stack height H is obtained by a selected number of folded layers 43 in the stack, so that its cross sectional area is equal to W·H. So that pre-existing connector components for the round wire can continue to be used with the flat wire cable, the number of folded layers 43 is chosen so that the cross sectional area W·H is approximately equal to the cross sectional area $$\pi \cdot \left(\frac{D}{2}\right)^2.$$

Figure 6C:
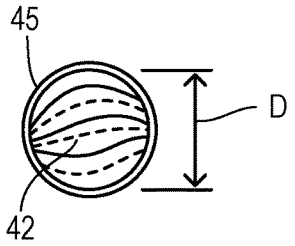
FIG. 6C is a cross-sectional view of the stack of FIG. 6B after crimping by a ferrule.

After crimping of a ferrule 45 as shown in FIG. 6C, a round diameter D is obtained substantially equal to the diameter of the round wire being replaced. Thus, a solid cylindrical body is formed which is well adapted for crimping into a contact body as part of a multi-pin connector assembly of the type used with round wires.

Figure 7:
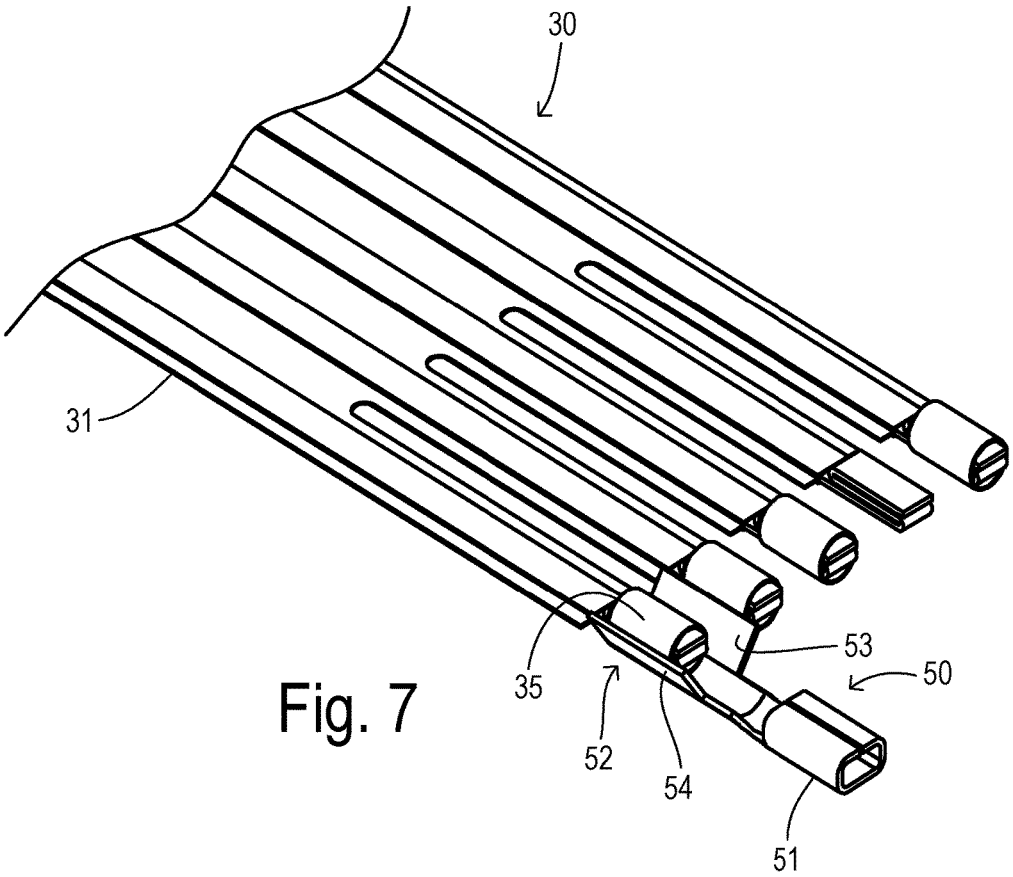
FIG. 7 is a perspective view of a terminal end of a flat flexible cable system with wires in various stages of processing, including a folded end, ends with crimped ferrules, and an end with a crimped ferrule with a round-wire contact body in place for crimping to the ferrule.
Figure 8:
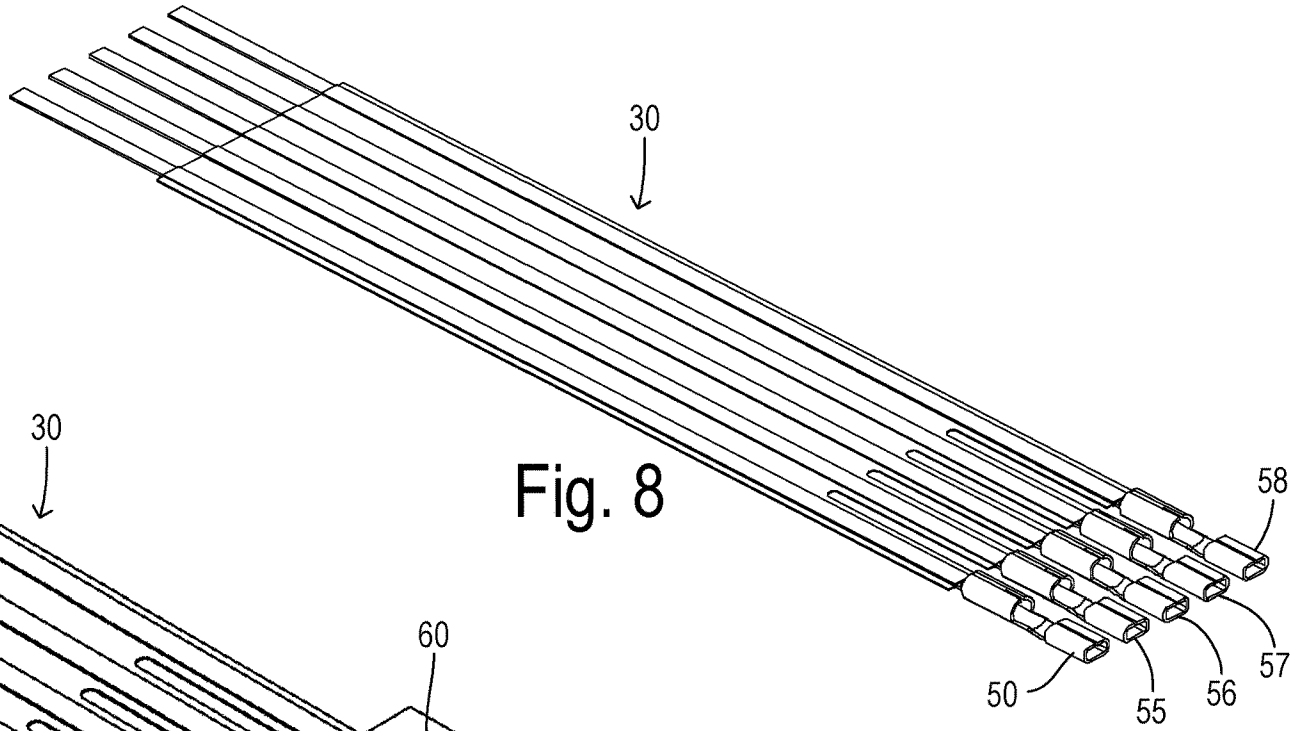
FIG. 8 is a perspective view of a terminal end of a flat flexible cable system with contact bodies added for each individual wire.
Figure 9:
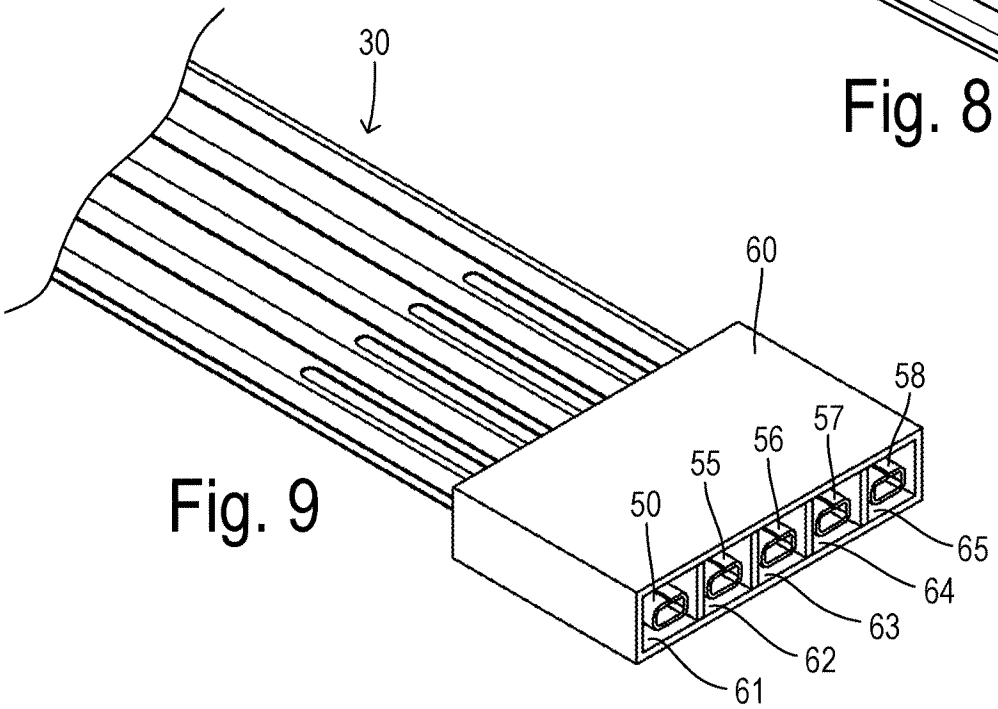
FIG. 9 is a perspective view of a terminal end of a flat flexible cable system with the contact bodies assembled to a carrier block of a connector.

FIG. 7 shows a contact body 50 in position for assembly with ferrule 35 of a prepared terminal end of a flat wire. Contact body 50 has a coupler end 51 which in this example is shown as a socket for receiving a pin (e.g., a pin extending from a connector header of an electronic module). The other end of contact body 50 is a crimp end 52 with legs 53 and 54 for crimping over ferrule 35 to form a barrel which secures contact body 50 in place while establishing electrical continuity. A conventional manufacturing processes and associated equipment can be used for adding the contact bodies, resulting in a configuration as shown in FIG. 8 with contact bodies 50 and 55-58. A completed harness connector as shown in FIG. 9 is obtained by adding a carrier block 60 having bores 61-65 as known in the art for receiving contact bodies 50 and 55-58.

Figure 10:
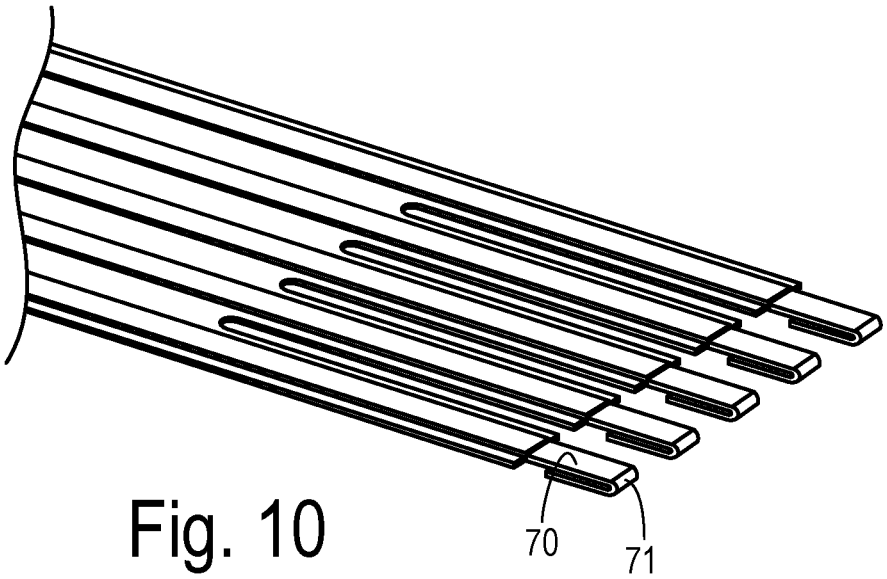
FIG. 10 is a perspective view of a terminal end of a flat flexible cable system with an alternate folding.
Figure 11:
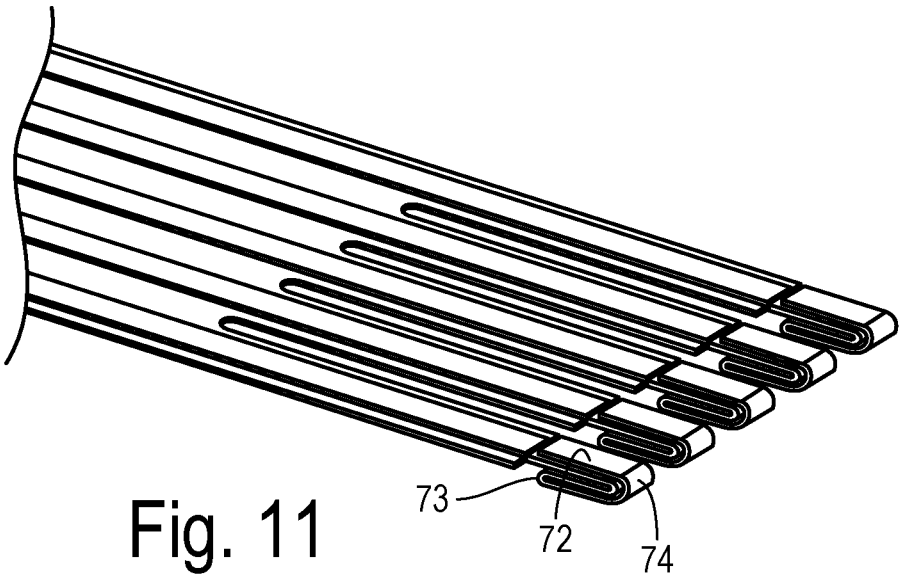
FIG. 11 is a perspective view of a terminal end of a flat flexible cable system with an alternate folding.

The lateral folding of the flat-wire blade fingers may be comprised of various numbers of folds. In FIG. 10, a blade finger 70 is folded once with a single-layer fold 71. In FIG. 11, a blade finger 72 is folded twice: first with a single-layer fold 73 and then with a double-layer fold 74. As a result of a double-layer fold, a stack having a thickness four times greater than the original thickness can be obtained with two folds. The folding operation can be performed in a straightforward manner using known equipment such as a high-speed moving single-head or multi-head progressive brake press (e.g., a moving die head will keep the flex wire stationary while the terminal ends are folded back).

Figure 12:
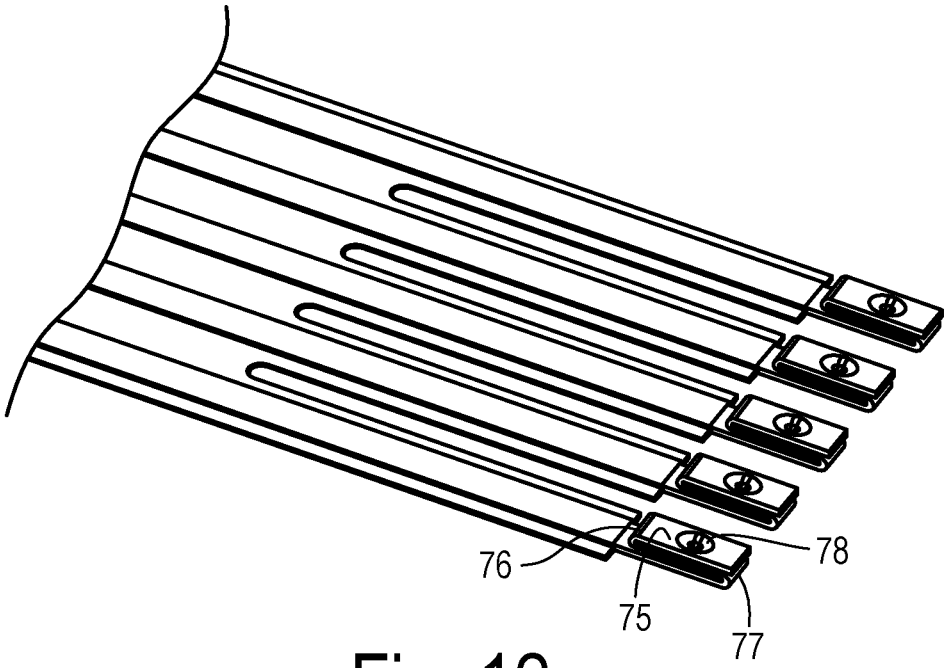
FIG. 12 is a perspective view of a terminal end of a flat flexible cable system with spot welding of a folded stack.

If handling of the folded blades from the time they are folded until they are compressed by a crimped ferrule is such that the folding might not be sufficiently maintained, then a metal joining operation can be used. As shown in FIG. 12, for example, a blade finger 75 with a pair of single-layer folds 76 and 77 is provided with a spot weld 78 after folding (and prior to applying the ferrule).

Figure 13:
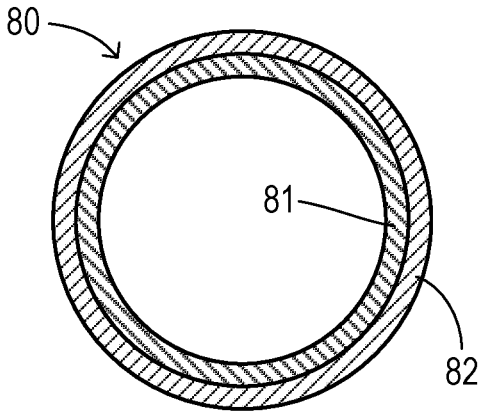
FIG. 13 is a cross-sectional view of a bimetallic ferrule of the invention.

The flat wires used in the invention can be composed of any suitable metal, such as copper or aluminum. Likewise, the contact bodies could be any suitable metal. In the event that dissimilar metals are used (such as aluminum flat wires and copper contact bodies), then corrosion could occur at the interface between the metals. To avoid such corrosion, the invention can employ a bimetallic ferrule 80 as shown in FIG. 13. An inner layer 81 is comprised of a first metal (e.g., aluminum) compatible with the metal of the blade fingers, and an outer layer 82 is comprised of a second metal (e.g., copper) compatible with the metal of the contact bodies. Since the interface between the dissimilar metals is environmentally sealed, the corrosion does not occur.

What is claimed is:

1. Electrical distribution apparatus comprising:

a flat flexible cable having an insulating substrate embedding a plurality of flat wires, and having a cable end wherein the wires extend as exposed blade fingers, each having at least one lateral fold stacking a thickness of the respective finger;

a ferrule crimped over each stacked finger;

a plurality of contact bodies each with a coupler end and a crimp end with a pair of legs crimped onto a respective ferrule; and a carrier block having a plurality of bores each receiving a respective coupler end;

wherein the ferrule is comprised of a bimetallic cylinder having an inner layer comprising a first metal compatible with the blade fingers and an outer layer comprising a second metal compatible with the contact bodies.

2. The apparatus of claim 1 wherein each crimped ferrule has a rounded profile with a predetermined cross sectional area adapted for crimping by the crimp ends, and wherein each stacking thickness and a lateral width of each finger provides a rectangular profile prior to crimping corresponding to the predetermined cross sectional area.

3. The apparatus of claim 1 wherein the fingers each has a plurality of single-layer folds.

4. The apparatus of claim 1 wherein the fingers each has at least one single-layer fold and at least one double-layer fold.

5. The apparatus of claim 1 wherein each stacked finger includes a spot weld for maintaining the stacking prior to crimping of a respective ferrule.

6. The apparatus of claim 1 wherein the coupler ends are comprised of female sockets adapted to mate with an electronic module in an automotive vehicle.

7. The apparatus of claim 1 wherein the first metal is aluminum and the second metal is copper.

8. An automotive wiring system comprising:

an insulated cable section embedding a plurality of flat wires extending at one end as exposed fingers, each having lateral folds forming an end stack;

a respective metallic ferrule crimped over each end stack;

a plurality of contact bodies each having a coupler at one end and the other end crimped onto a respective ferrule; and a carrier block having a plurality of bores each receiving a respective coupler;

wherein the ferrule is comprised of a bimetallic cylinder having an inner layer comprising a first metal compatible with the fingers and an outer layer comprising a second metal compatible with the contact bodies.

9. The system of claim 8 wherein each crimped ferrule has a rounded profile with a predetermined cross sectional area adapted for crimping by the crimped ends of the contact bodies, and wherein each end stack has a thickness and a lateral width which provides a rectangular profile prior to crimping corresponding to the predetermined cross sectional area.

10. The system of claim 8 wherein the fingers each has a plurality of single-layer folds.

11. The system of claim 8 wherein the fingers each has at least one single-layer fold and at least one double-layer fold.

12. The system of claim 8 wherein each stacked end includes a spot weld for maintaining the stacking prior to crimping of a respective ferrule.

13. The system of claim 8 wherein the couplers are comprised of female sockets adapted to mate with an electronic module in an automotive vehicle.

14. The system of claim 8 wherein the first metal is aluminum and the second metal is copper.

15. Electrical distribution apparatus comprising:

a flat flexible cable having an insulating substrate embedding a plurality of flat wires, and having a cable end wherein the wires extend as exposed blade fingers, each having at least one lateral fold stacking a thickness of the respective finger;

a ferrule crimped over each stacked finger;

a plurality of contact bodies each with a coupler end and a crimp end with a pair of legs crimped onto a respective ferrule; and a carrier block having a plurality of bores each receiving a respective coupler end;

wherein each stacked finger includes a spot weld for maintaining the stacking prior to crimping of a respective ferrule.

* * * * *